US005203386A

United States Patent [19]

Harp

[11] Patent Number: 5,203,386

[45] Date of Patent: Apr. 20, 1993

[54] SECONDARY CONTAINMENT OF ABOVE-GROUND TANKS FOR FLAMMABLE MATERIALS

[75] Inventor: Robert W. Harp, Pilot Mountain, N.C.

[73] Assignee: Industrial Environmental Supply, Inc., Greensboro, N.C.

[21] Appl. No.: 794,951

[22] Filed: Nov. 20, 1991

Related U.S. Application Data

[63] Continuation of Ser. No. 516,291, Apr. 30, 1990.

[51] Int. Cl.[5] ..... B65B 1/04

[52] U.S. Cl. ..... 141/86; 141/88; 141/311 A

[58] Field of Search ..... 141/86, 88, 98, 311 A; 220/86 R, 254, 571, 402, 566, 801, 445, 425, 445, 465, 565; 222/108, 183

[56] References Cited

U.S. PATENT DOCUMENTS

| | | | |
|---|---|---|---|
| 3,225,955 | 12/1965 | Farkas et al. | 220/429 |
| 4,815,621 | 3/1989 | Bartis | 220/203 |
| 4,960,222 | 10/1990 | Fields, III | 220/445 |
| 5,071,166 | 12/1991 | Marino | 220/571 |

OTHER PUBLICATIONS

Areo Power 1988.

*Primary Examiner*—Henry J. Recla
*Assistant Examiner*—David J. Walczak
*Attorney, Agent, or Firm*—Rhodes, Coats & Bennett

[57] ABSTRACT

An above-ground secondary containment system for a primary tank holding liquids includes a dike surrounding the tank, a hood over the dike for preventing ambient precipitation and trash from entering the dike and preventing evaporation of liquids spilled or leaked from the primary tank and contained by the dike, and a closable tank port access means in the hood for permitting access to tank input or output ports when desired, but closable to maintain the hood's property of preventing ambient precipitation and trash from entering the dike at other times. In one embodiment, the dike is a right parallepiped having an open top and a floor and the hood includes a flat top surface and surfaces sloping downward, from the flat top surface to opposing sides of the right parellepiped. The sloping surfaces have inwardly turned flanges along their lower edges to return liquid condensate flowing down the inside of the sloping surfaces to the dike.

24 Claims, 3 Drawing Sheets

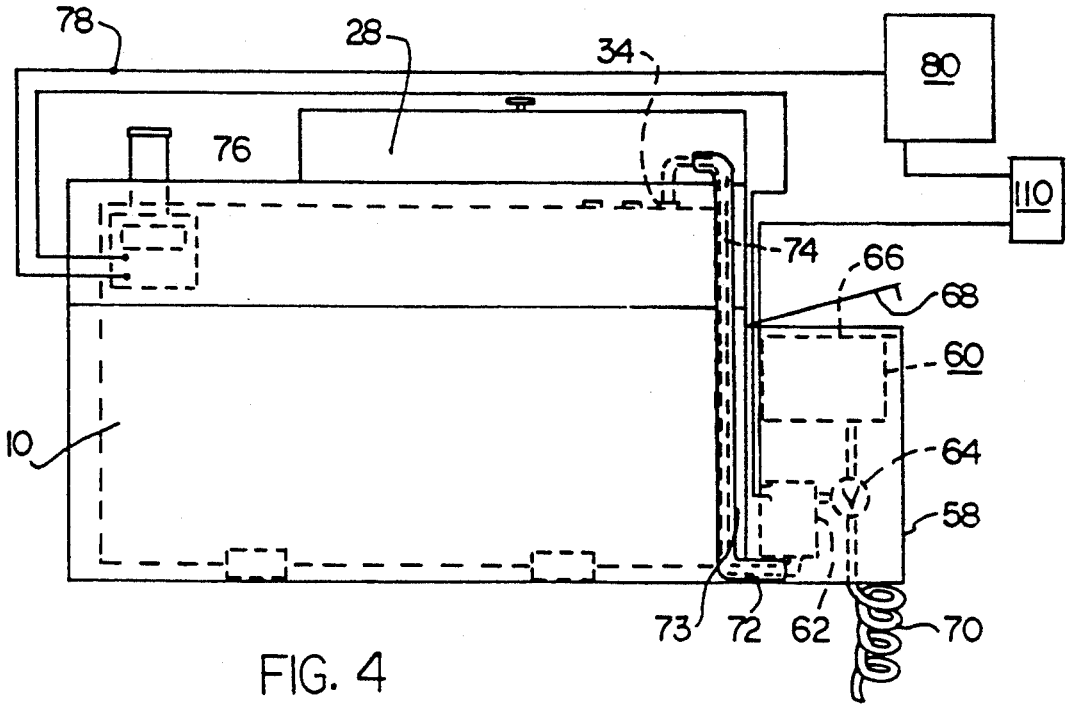
FIG. 4
FIG. 5
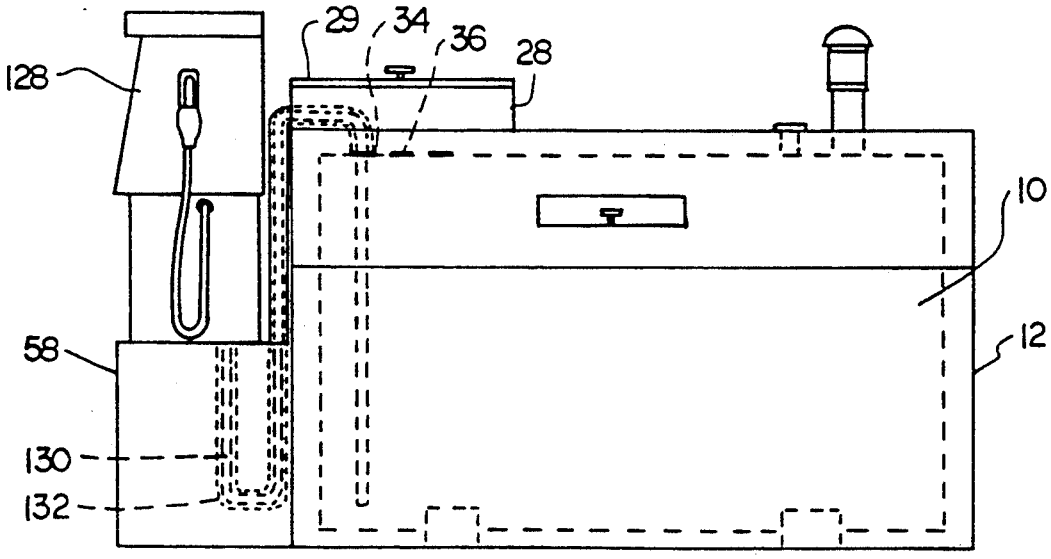

SECONDARY CONTAINMENT OF ABOVE-GROUND TANKS FOR FLAMMABLE MATERIALS

This application is a continuation of application Ser. No. 516,291, filed Apr. 30, 1990.

BACKGROUND OF THE INVENTION

The present invention relates to secondary containment systems for above-ground tanks for holding hazardous and non-hazardous materials such as petroleum products, solvents, paint thinners or any other liquid which would cause an environmental problem if released into the ground. It is particularly useful for flammable liquids; that is, those with a flashpoint below 100° F.

Recently-adopted regulations of the Environmental Protection Agency require that above-ground tanks be provided with a secondary containment device to catch and retain any spills or leaks from the primary above-ground tank. Known products for this purpose have taken the form of a large open-topped tub, usually called a dike, into which the primary tank is placed. While this arrangement permits leaks and overfills to be caught and prevented from contaminating the ground, such leaks and overspills are exposed to the atmosphere and may be contaminated by rain, snow or trash thrown into the open tub. If the leaked or overfilled product is otherwise usable, such contamination would render it not usable, such that it must be treated as hazardous waste, rather than valuable, usable product. For waste products, such contamination may make the purification, recycling or other handling of the products more difficult.

In addition, exposing such leaked or spilled products to the atmosphere in an open tank may contribute to atmospheric pollution, since many such products are volatile and will evaporate from an open-topped dike, thereby contributing to smog and other air pollution. Furthermore, spilled volatiles held in an open-topped dike pose an explosion hazard. In one case, in which gasoline leaked from a tank into an open-topped dike evaporated, the vapor travelled in the prevailing wind a mile to a mobile home park, where a water heater pilot light caused an explosive ignition. The flame travelled the route back to the storage tank on a trail of vapor, engulfing the tank in flames. Even when evaporation does not lead to such tragic circumstances, economic loss due to the simple loss of product through vaporization is an undesirable feature of open-topped dike secondary containment devices. The safety aspect of the storage of flammable materials has long been regulated. Materials are classed as flammable by the National Fire Protection Association if they have a flashpoint below 100° F. Examples are gasoline and kerosene. Materials with a flashpoint at or above 100° F. such as motor oils, transmission fluids, hydraulic oil, paraffin or synthetic base lubricating oils, No. 2 fuel oil, No. 4 fuel oil and cutting oil are classed as combustible materials since they have flashpoints above 100° F. The lower flashpoimts of flammable materials makes them more likely to ignite with explosive or burning results than combustible materials. Also, the lower flashpoints usually mean that the vapor pressure of a flammable material will be higher at a given temperature than for a combustible material. These two attributes of flammable materials, capability of exploding and increased vapor pressure, have caused safety agencies such as the National Fire Protection Association and Underwriters Laboratories, Inc. (UL) to adopt well-recognized standards applicable to tanks for holding flammable materials. That is, in order to be approved for such use by those agencies (and regulatory authorities such as OSHA, U.S.D.O.T., and local building codes which have adopted NFPA and UL standards as their own), the tanks must be tested to withstand 5 to 7 psig, among other requirements. Thus, a tank for holding flammable liquids must meet those standards in order to be commercially practical. The standards involved are NFPA Standard 30 and UL 142.

Accordingly, there is an need in the art for a secondary containment device for above-ground primary holding tanks for both raw materials and hazardous waste, which overcomes the problems of contamination of product, undue exposure of the atmosphere to polluting or hazardous volatiles and vapor spilled product.

SUMMARY OF THE INVENTION

The present invention solves these problems by providing an above-ground secondary containment system for a primary tank holding flammable liquids including a dike surrounding the tank, a hood over the dike for preventing ambient precipitation and trash from entering the dike, and a closable tank port access means in the hood for permitting access to tank input or output ports when desired, but closable to maintain the hood's property of preventing ambient precipitation and trash from entering the dike at other times. Preferably, the dike and hood substantially completely enclose the tank. In one embodiment, the dike is a right parallepiped having an open top and a floor. The hood may include a flat top surface and surfaces sloping downward from the flat top surface to opposing sides of the right parellepiped. Preferably, the sloping surfaces have inwardly turned flanges along their lower edges to return liquid condensate flowing down the inside of the sloping surfaces to the dike.

The containment system may be marketed with an installed tank or without an installed tank, with the user installing the tank himself. This is particularly possible when the dike and hood are secured together by a removable securing means so that they may be separated for tank installation, maintenance or repair. Such a removable securing means also permits the hood to be blown free of the dike in the vent of an explosion of the flammable vapors in the dike, without rupturing the dike. This permits the dike and hood combination to meet UL requirements for holding flammable liquids.

Preferably, the dike is provided with internal support means to support the tank above the floor of the dike and an external support means to support the dike above the ground.

Preferably, the closable tank port access means includes an opening in the hood aligned with the expected tank input or output ports and covered by a hinged door. More preferably, the opening is in a horizontal plane at the top of the housing extending above the hood. Particularly preferred is for the hinged door to be provided with peripheral flanges which extend downwardly outward of the housing. The housing may also be provided with at least one additional port for receiving input or output fluid lines. Such additional fluid line may be a dual wall fluid line such that an inner line is in communication with the interior of the tank and an outer line is in communication with the interior of the housing.

Preferably, a closable access way in one of the sloping sides of the hood is provided to permit the inspection of the tank and of the interior of the dike to check for leakage from the tank. More preferably, the access way is closed by a door hingedly mounted above the access way.

In a preferred embodiment, the hood is provided with an opening to receive a vent pipe extending from the tank.

In one embodiment, a pump is also provided with an pump inlet in the dike and a pump outlet in the tank such that liquid which has leaked from the tank or been overspilled into the dike may be pumped from the dike into the tank. A pump may also be provided mounted on the outside of the dike for pumping liquid into the tank. A sink may also be provided at a convenient height on the outside of the dike having a drain to the pump. In addition, a hose may be connected to an inlet to the pump to permit remotely contained fluids to be pumped into the tank.

Preferably, a level detector mounted in the tank is operatively associated with the pump to disable the pump when the tank is full and/or to provide an indication to a user when the tank is full. The sink may also be provided with a grate on which liquid-containing items may be placed to drain the liquid to the sink.

A pump connection may also be provided for pumping liquid out of the tank, with a pump connection line passing through the hood and tank to the tank interior.

Preferably, the volume of the dike is at least 100 percent of the volume of the primary tank.

The invention also provides a process of storage and handling usable hazardous, flammable or toxic liquids comprising the steps of storing a liquid in an above-ground primary tank enclosed by a secondary containment system which prevents ambient precipitation and trash from entering the secondary containment system and pumping leaked or overfilled liquid from the secondary containment system into the primary tank for storage.

By providing completely surrounding containment of the spilled product, the present invention greatly reduces evaporation of the product, thereby reducing air pollution, explosion hazards, and loss of product. In addition, since the product is not contaminated, it can be reclaimed.

Furthermore, the invention also provides a process of storage and handling hazardous waste or toxic waste liquids including the steps of providing an above-ground primary tank enclosed by a secondary containment system with a pump inletting to the primary tank and pumping the waste liquid into the tank from a sink or from a remote location.

BRIEF DESCRIPTION OF THE DRAWINGS

The invention will be better understood by a reading of the following detailed description along with a review of the drawings in which:

FIG. 4 is a side view, partially elevation and partially schematic, of an alternative embodiment;

FIG. 5 is a side elevation view of yet another embodiment; and

DETAILED DESCRIPTION OF PREFERRED EMBODIMENTS

The present invention provides a secondary containment enclosure for above-ground tanks for holding hazardous or toxic liquids but is particularly useful for holding flammable liquids such as gasoline, kerosene, solvents or othe petroleum products, other mixtures and solutions. The invention may be used on the one hand in connection with liquids which are stored as usable fuels, feedstocks or other raw materials, or on the other hand in connection with storage of waste materials. In general, the arrangement of piping and pumps will differ, depending on which of these two broad categories of usage is intended for the device. The device can be made in a wide range of sizes, to accommodate primary tanks of 270 gallons up to 30,000 gallons or larger, as desired.

Figure 2:
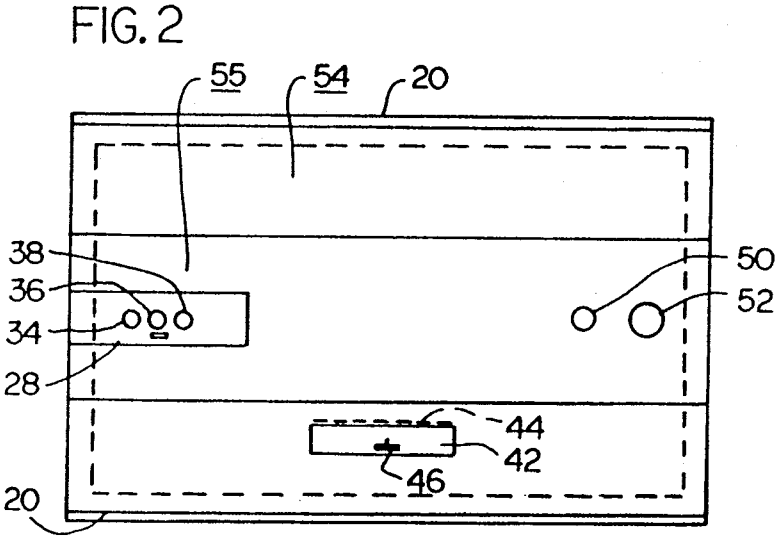
FIGS. 2 and 3 are a top view and side view respectively of the embodiment of FIG. 1.
Figure 3:
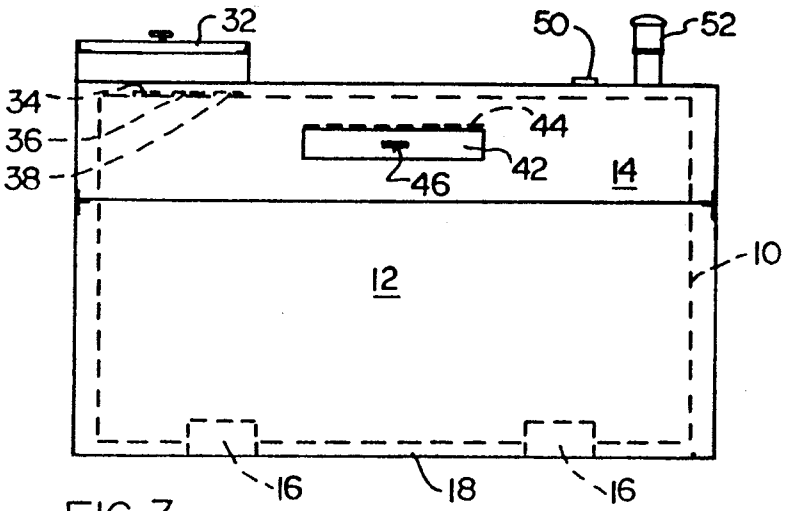
Figure 1:
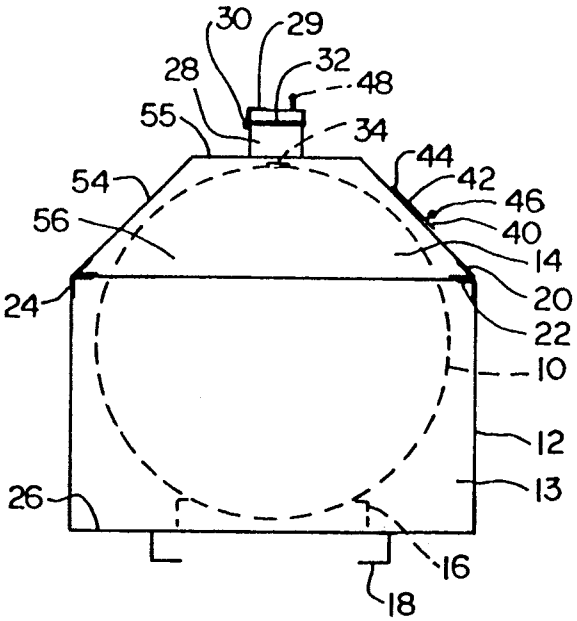
FIG. 1 is an end elevation view of an embodiment of the present invention.

FIGS. 1, 2 and 3 illustrate the basic hardware of the apparatus which is used as a secondary containment tank for a closed cylindrical primary tank 10, shown in phantom in all three figures. The secondary containment system includes a dike 12 and a hood 14. The dike is arranged as a right parallepiped, including a floor 26 and upstanding side walls 13,15 on four sides, with an open top. An external support 18 is provided so that the apparatus can be manipulated by a fork truck or the like. An internal support 16 for tank 10 is also provided on the floor 26, to keep the shell of tank 10 out of contact with the dike.

The dike has a peripheral rim 22 as an inwardly extending flange from the upstanding side walls 13,15.

The hood 14 includes two sloping side walls 54, a flat top wall 55, and a pair of vertical end walls 56. The sloping side walls 54 have inwardly turned flanges 20 which rest on the rim 22 on the dike. The hood is secured to the rim by nut and bolt securement means 24. If desired, the end walls 56 may be made of a separate sheet of material bolted to flanges on the walls 54,55.

The rim and flanges 20 form a sufficient contact to make an airtight seal. Thus, the tank and hood combination does not leak vapor, even at the elevated vapor pressures that may be generated by evaporation of spilled flammable liquid which may have spilled into the dike, as required by UL standards. The seam formed by the rim 22 and flange 20, held together by nut and bolt securement means 24, will still be the weakest part of the secondary containment. Therefore, if the vapor should somehow be ignited and set off on explosion, the seam will open, lifting the hood 14 off of the dike so that the explosive force can be dissipated as benignly as possible. After such an explosion, the dike 10 will likely still be intact, containing the flammable liquid, rather than letting a flaming spill spread destruction.

A housing 28 is formed on top of the top wall 55, in alignment with the primary tank ports 34,36,38 as shown in FIG. 2. The housing 28 is provided with a door 29 mounted by a hinge 30 to the housing 28. The door 29 has downwardly extending flanges 32 outward of the housing 28, to form a baffle to keep rain and the like from entering the housing 28 when the door 29 is closed. A handle 48 is provided on the door 29. As will be apparent, the portion of the flat top wall 55 underlying the housing 28 is cut away so that when door 29 is open, access may be had to the ports 34,36,38.

A second opening 40 is formed in the side wall 54 of the hood, covered by a door 42 hingedly mounted above the opening 40 and provided with a handle 46. By opening door 42, an inspector can check for leakage or overspills contained in dike 12. Having door 42 hinged at the top prevents rainwater from entering the hood 14 through opening 40.

A vent opening 52 is provided in the hood 14 aligned with a vent in the inner tank and provided with a conventional standpipe. An emergency vent opening 50 is also provided in the hood 14 in alignment with emergency vent in the primary tank 10.

The apparatus of FIGS. 1–3 serves to provide a secondary containment system for.the primary tank 10. Thus, a leak in primary tank 10 will be contained in the dike 12 and not be passed to the underlying ground and causing contamination. In addition, since the fill ports 34–38 are housed within the hood 14 and access had through housing 28, any overfill of liquid being filled into the tank 10 will be caught by the dike 12 in similar fashion. Any such spill or overfill ih dike 12 will be protected from contamination (such as rain, snow, windblown leaves or trash dumped by humans) by virtue of the hood 14. Thus, such liquid collected in dike 12 can be repumped into the primary tank 10 for reuse. In addition, the support 16 provides further protection for the primary tank 10 to prevent corrosion or other iamage. Moreover, by enclosing any spilled liquid in the dike 12, the hood prevents or minimizes the evaporation of volatiles to the atmosphere, thus minimizing atmospheric pollution, explosion hazards and evaporative loss of product. The inwardly turned flanges 20 serve as weirs to return any condensed volatiles to the dike and to prevent their leaking out the seam between the dike and hood.

As will be apparent, other arrangements of dike and hood or similar components can be used to provide secondary containment of a primary tank, while protecting spilled or leaked liquids from contaminations and minimizing evaporation thereof. For instance, a shell substantially completely surrounding the primary tank could be used.

A further embodiment of the invention will be discussed with respect to FIG. 4 in which certain appurtenances are added to the basic secondary containment apparatus depicted in FIGS. 1–3. A housing 58 is cantilevered on the outside of one end of dike 12 and provided with a hinged cover 68 opening to a sink 60 covered by a grate 66. The sink 60 drains to a valve 64, as does as a hose 70. A pump 62 impells fluid from valve 64 through piping 74 which extends outward of housing 58, up the exterior of dike 10 and hood 14 into housing 28. Piping 74 is jacketed by a secondary piping 73 extending from the pump 62 to the housing 28. Thus, if piping 74 leaks, leaked fluid will be discharged into housing 58 for containment by dike 12. Depending on the setting of valve 64, pump 62 pumps liquid from the sink 60 or a remote location accessed by hose 70 into input tank port 34 through the piping 74. Preferably, the pump 62 is an air pump, but any suitable pump design may be used. Pump 62 is powered by an electrical power supply 80 connected through power supply line 78 to a level detector/switch and alarm 110. Thus, when the tank is filled, the level detector/switch 76 will open the circuit to the pump 62, disabling further dispensing into the tank 10 and preventing an overfill, and actuating alarm 110 to indicate the full condition, so that measures to drain the tank 10 can be taken. The embodiment shown in FIG. 4 is particularly useful for the collection and storage of waste liquids. In particular, the sink 60 and grate 66 may be used to drain waste motor oil from oil filters and have the waste pumped into tank 10 by pump 62.

FIG. 5 illustrates the invention adapted for use in storing usable fuel such as gasoline or diesel fuel in the primary tank 10. The housing 58 mounted on the outside of the dike supports a conventional fuel pump 128 connected by supply line 130 through the housing 58 and through port 34 in tank 10. A secondary pipe 132 surrounds the supply pipe 130 in the housing 58 and jackets pipe 130 as pipe 130 enters housing 28 at which point secondary pipe 132 opens into the housing 28, so any leaks in supply pipe 130 are returned to the dike 12. As will be apparent, the tank 10 can be refilled by supplying it through port 36 after opening door 29.

Figure 6:
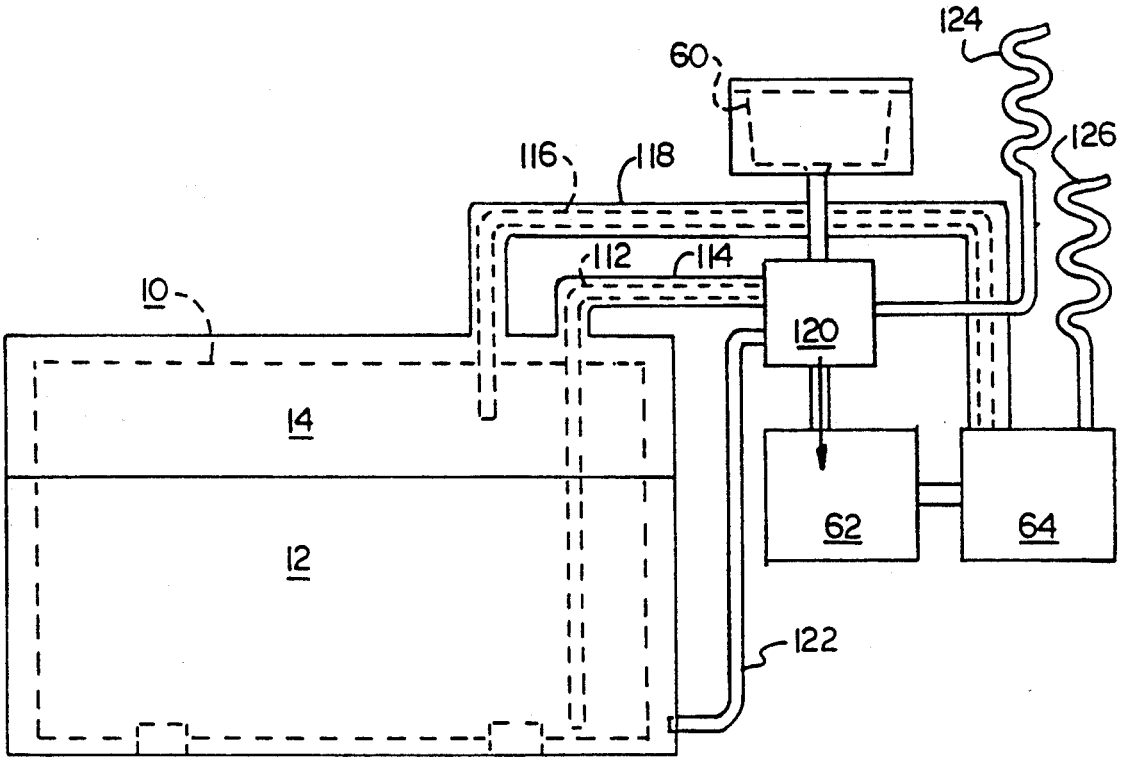
FIG. 6 is a schematic view illustrating various pump and piping arrangements.

A schematic arrangement showing various ways in which tank 10 inside the dike 12 can be supplied and drained is shown in FIG. 6. It is unlikely that any one tank installation would use all of these features, but the figures are illustrative of the types of combinations of infeed and draining which are possible. Thus, a pump 62 is provided with an inlet valve 120 and an outlet valve 64. Inlet valve 120 may receive fluid and supply it through pump 62 from hose 124, sink 60, pipe 112 draining tank 10 and pipe 122 draining dike 12. The outlet valve 64 may supply fluid pumped by pump 62 outwardly through hose 126 or may direct fluid via line 116 to tank 10.

As seen in FIG. 6, lines 112,116 are encased in secondary pipes 114,118, respectively to provide secondary containment of any leaks in the inner pipes. As discussed above, the outer casings 114,118 terminate at the housing 28 (not shown in FIG. 6) at the top of hood 14, so that any fluids leaking from lines 112,116 will be discharged into dike 12 and prevent a spill.

The apparatus of FIG. 6 may be operated so that the inlet valve 120 receives the liquid from tank 10 via line 112 and the outlet valve 64 adapted to discharge the liquid through hose 126. This arrangement would be similar to the arrangement shown in FIG. 5, with the pump 62 acting as a fuel dispensing pump.

In an alternative arrangement, the inlet valve 120 may drain dike 12 through line 122 and the outlet valve 64 be arranged to deliver that fluid via line 116 to tank 10. This arrangement would be used in the event of a leak or overspill of tank 10, with tank 10 being used as a fuel storage tank, to return the non-contaminated fuel to the tank 10 for reuse.

The apparatus of FIG. 6 may be also configured for use of the tank 10 as a hazardous or toxic waste storage tank in which inlet valve 120 would most commonly be adapted to drain sink 60 or hose 124 and outlet valve 64 would be set to deliver pumped fluid through line 116 into tank 10, thereby delivering the collected fluid to the tank 10. In the event of an overspill of fluid into dike 12 or a leak in tank 10, inlet valve 120 may be arranged to withdraw such fluid from dike 12 via line 122 and return the liquid to the tank via line 116. When tank 10 is to be emptied, such as to deliver the collected hazardous waste to a processor, inlet valve 120 may be adjusted to drain tank 10 through line 112 and outlet valve 64 adjusted to output the liquid through hose 126 to a tank truck or the like for cartage of the liquid to a reprocessing plant. Of course, the level sensing and pump shut off/alarm arrangement of FIG. 4 may desirably be used in the embodiment of FIG. 5 or any embodiment of which FIG. 6 is illustrative.

As will be apparent, the connections to the secondary containment dike and hood may take many forms depending on the nature of the liquid being stored in the tank, all yielding substantial benefits over prior open-topped dikes. Accordingly, the foregoing discussion and description of embodiments should be deemed to be exemplary only and not limiting, that is, the invention may take a variety of forms, yet fall within the scope of the appended claims.

What is claimed is:

1. An above-ground secondary containment system comprising:

a) a closed tank suitable for holding liquid and having an input port and a dike surrounding said tank;

b) a hood over said dike for preventing ambient precipitation and trash from entering said dike; and c) a closable tank port access means in said hood for permitting access to said tank input port when desired but closable to maintain said hood's property of preventing ambient precipitation and trash from entering said dike at other times and communicating with said dike so that spilled liquid adjacent said tank input port may be directed to said dike.

2. A system as claimed in claim 1 wherein said dike and said hood substantially completely enclose said tank.

3. A system as claimed in claim 2 wherein said hood is provided with an opening to receive a vent pipe extending from said tank.

4. A system as claimed in claim 2 wherein said dike is a right parallelpiped having an open top and a floor.

5. A system as claimed in claim 4 wherein said hood includes a flat top surface and surfaces sloping downward from said flat top surface to two opposing sides of said right parallelpiped.

6. A system as claimed in claim 3 further comprising a closable accessway in one of said sloping sides to permit the inspection of said tank and the interior of said dike to check for leakage from said tank.

7. A system as claimed in claim 6 wherein the accessway is closed by a door hingedly mounted above the accessway.

8. A system as claimed in claim 2 wherein esaid dike and hood are secured together by a removable securing means.

9. A system as claimed in claim 8 wherein said dike has a floor and is provided with internal support means to support said tank above said floor.

10. A system as claimed in claim 9 wherein said dike is provided with external support means to support the dike above the ground.

11. A system as claimed in claim 1 wherein said closable tank port access means is in an opening in said hood and aligned with tank input port and covered by a hinged door.

12. A system as claimed in claim 11 further comprising a housing extending above said hood and wherein said opening is in a horizontal plane at the top of said housing.

13. A system as claimed in claim 12 further comprising a pump mounted on the outside of said dike for pumping liquid out of said tank and a pump connection line passing from said pump through the housing to said tank's interior.

14. A system as claimed in claim 12 wherien said hinged door is provided with peripheral flanges which extend downwqrdly outward of said housing.

15. A system as claimed in claim 12 wherein said housing has at least one additional port for receiving input or output fluid lines.

16. A system as claimed in claim 15 wherien said fluid line is a dual wall fluid line such that an inner line is in communication with an interior of said tank and an outer line is in communication with an interior of said housing.

17. A system as claimed in claim 1 further comprising a pump mounted on the outside of the dike for pumping liquid into said tank.

18. A system as claimed in claim 17 further comprising a hose connected to an inlet to said pump.

19. A system as claimed in claim 17 further comprising a level detector mounted in said tank which disables said pump when said tank is full.

20. A system as claimed in claim 17 further comprising a level detector mounted in said tank which provides an indication to a user when said tank is full.

21. A system as claimed in claim 1 wherein the volume of the dike is at least 100% of the volume of said tank.

22. A system as claimed in claim 1 wherein said tank is capable of withstanding 5 to 7 psig internal vapor pressure and suitable for safely and legally holding flammable liquids and said dike contains vapors from liquid spilled or leaked from said tank.

23. An above-ground secondary containment system for safely and legally holding liquids which ahve explosive vapors comprising:

a) a closed tank and a dike surrounding said tank;

b) a hood over said dike for containing vapors from liquid spilled or leaked from said tank; and c) a closable tank port access means in said hood for permitting access to a tank input port when desired but closable to maintain said hood's property of containing vapors at other times and communicating with said dike so that spilled liquid adjacent said tank input port may be directed to said dike.

24. An above-ground secondary containment system comprising:

a) a closed tank suitable for holding liquid and having an input port in an upper portion thereof, b) a dike surrounding said tank, c) a hood over said dike for preventing ambient precipitation and trash from entering said dike, and having an input port in an upper portion thereof, and d) a double-walled pipe including an inner wall pipe connected to said input port in said closed tank and an outer wall pipe having said inner wall pipe within it and being connected to said input port in said hood, so that leaks in said inner wall pipe are contained within said outer wall pipe, said hood or said dike.

* * * * *